United States Patent [19]

Wojtanek

[11] Patent Number: 4,833,440

[45] Date of Patent: May 23, 1989

[54] CONDUCTIVE ELASTOMERS IN POTENTIOMETERS & RHEOSTATS

[75] Inventor: Guy A. Wojtanek, Franklin Park, Ill.

[73] Assignee: Eaton Corporation, Cleveland, Ohio

[21] Appl. No.: 249,218

[22] Filed: Sep. 26, 1988

Related U.S. Application Data

[63] Continuation of Ser. No. 3,894, Jan. 16, 1987, abandoned.

[51] Int. Cl.[4] ..... H01C 10/10

[52] U.S. Cl. ..... 338/114; 338/99

[58] Field of Search ..... 338/114, 99, 150

[56] References Cited

U.S. PATENT DOCUMENTS

| | | | |
|---|---|---|---|
| 2,744,981 | 5/1956 | Spears | 338/114 X |
| 4,163,204 | 7/1979 | Sado et al. | 338/114 |
| 4,426,884 | 1/1984 | Polchaninoff | 338/114 X |

*Primary Examiner*—E. A. Goldberg
*Assistant Examiner*—M. M. Lateef
*Attorney, Agent, or Firm*—R. A. Johnston

[57] ABSTRACT

An apparatus for varying impedance includes a first conductive member, a second member associated therewith, and a third wiper member electrically contacting the first and second members. Use of a conductive rolling member as the third wiper member minimizes wear and degradation of all members. Alternately, or in conjunction with a rolling wiper member, use of a conductive elastomer further eliminates wear.

27 Claims, 3 Drawing Sheets

CONDUCTIVE ELASTOMERS IN POTENTIOMETERS & RHEOSTATS

This application is a continuation of application Ser. No. 003,894, filed 1.16.87.

BACKGROUND OF THE INVENTION

This invention pertains to the art of means for varying the impedance through a circuit and more particularly to potentiometers, rheostats, and the like.

The invention is particularly applicable to a hand actuated rheostat and will be described with particular reference thereto. However, it will be appreciated that the invention has broader applications and may be advantageously employed in other electrical environments and applications.

Typically, a variable impedance element employs a movable wiper designed for electrical contact with a circuit element that may comprise conductive and/or resistive elements. The wiper is designed for sliding contact with the conductive and/or resistive elements and a great deal of effort has been expended to eliminate problems associated with mechanical wear resulting from the abrasive, wiping action. Although advancements have been realized in the art, the wear and degradation of the mechanically sliding elements continues to be a persistent problem.

Many of the variable impedance devices today employ a substrate in which resistive or conductive elements or tracks are traced thereon. Generally, these elements or tracks are printed on the substrate and are referred to as polymer thick film elements. These elements are not very abrasion resistant and usually require low contact forces with an associated wiper to eliminate harmful wearing action. The wiper may be electropolished to insure a burr-free surface which limits some of the abrasive interaction, but this is still not deemed to be an ideal solution.

Yet another problem associated with the polymer thick film elements is the resultant dead spots that may be formed therein. The films are formed of a polymeric material with carbon particles mixed in. If the resistivity of the element is high, there is, in turn, a low content of carbon. The uneven distribution and resultant absence of carbon in selected locations may cause dead spots in the resistive elements. To overcome this problem, past practice utilized multi-point wipers in an effort to avoid the dead spots and assure electrical contact with the carbon particles. A multi-point wiper normally requires a delicate, costly stamping operation. Additionally, conventional metallic wipers must be made of corrosion-resistant, conductive materials or must be plated adding even greater expense to an already expensive component.

One attempt to overcome some of these wear problems is found in U.S. Pat. No. 3,123,793, issued Mar. 3, 1964 to Flygstad, et al. That patent particularly discloses an impedance element having radially extending terminals at each end that extend outwardly from a generally cylindrical housing. A closed-loop, conductive tape contacts selected portions of the impedance element as a result of rotation of an elastic member. A central rotor member receives the elastic member in a drive groove so that rotation of the rotor is imparted to the elastic member which, in turn, abuts the conductive tape to provide selective electrical contact between various arcuate portions of the conductive tape and the impedance element. Although this patent has met with success, it is not believed to adequately solve all of the above detailed problems in an economical manner.

The subject invention is deemed to overcome these problems and others in an economical, reliable manner.

SUMMARY OF THE INVENTION

The present invention provides a wiper structure that either rolls with infinite point contact or provides a wiping contact with reduced abrasive action. Higher contact forces are provided without damaging the polymer thick film resistive elements and contact resistance between the wiper and the conductive/resistive elements is reduced as a result of the higher contact forces. The present arrangement eliminates any tendency of the components to corrode and tooling to produce the subject invention is minimal, yet accords a wide range and variety of configurations.

According to ths subject invention, an apparatus for varying impedance includes a first member operatively associated with a second member. A third member formed of a conductive elastomer is associated with the first and second members and selectively varies the impedance through a circuit including the first, second, and third members.

According to another aspect of the invention, the first and second members are formed from a conductive elastomer and the wiper is formed of any conductive material.

According to yet another aspect of the invention, the first and second members are disposed in generally diverging relation.

In accordance with another aspect of the invention, a conductive rolling member is operatively associated with the first and second members for completing electrical contact therebetween.

According to a further aspect of the invention, the conductive rolling member has any one of various cross-sectional configurations.

A principal advantage of the invention resides in the generally constant contact force between the wiper and conductive/resistive elements.

Yet another advantage of the invention is provided in the infinite point contact provided by a rolling wiper.

Yet another advantage resides in the reduced wear and corrosion resistance of the assembly.

Still another aspect of the invention is found in the minimal tooling costs and wide range of cross-sectional configurations.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein:

FIG. 15 illustrates another embodiment utilizing a rolling spherical elastomeric element.

DETAILED DESCRIPTION OF THE PREFERRED AND ALTERNATE EMBODIMENTS

Figure 1:
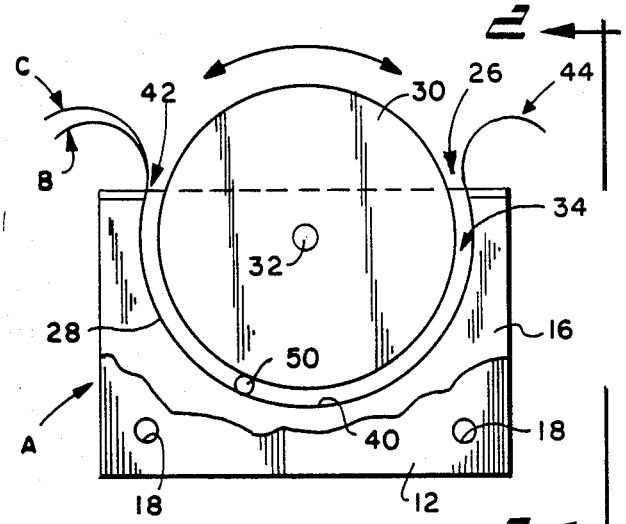
FIG. 1 is a vertical cross-sectional view of the subject invention.

Referring now to the drawings wherein the showings are for purposes of illustrating the preferred and alternate embodiments of the invention only and not for purposes of limiting same, the FIGURES show a variable impedance apparatus A that varies the resistance through an associated electrical circuit (not shown). Lead lines B and C extend from the variable impedance apparatus for associated electrical connection with another device in the circuit.

Figure 2:
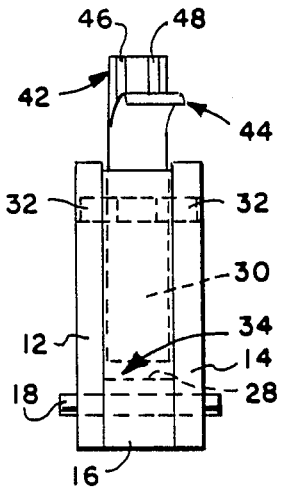
FIG. 2 is a side-elevational view, taken generally along the lines 2—2 of FIG. 1.

More specifically, and with reference to FIGS. 1 and 2, the variable impedance apparatus A includes a generally electrically inert housing 10 having a first or front wall 12 spaced from a second or rear wall 14. A central spacer 16, also electrically inert, is interposed between the first and second walls. As illustrated, the first and second walls are of generally rectangular, planar configuration and maintained in generally parallel relation to one another by the spacer 16. The configuration and spacing of the housing members is not critical so that other arrangements may be used without departing from the scope and intent of the the subject invention. Fastening means such as pins 18 are preferably disposed adjacent peripheral portions of the first and second walls and extend generally perpendicularly therethrough to maintain the walls and spacer in fixed relation. A greater or lesser number of pins 18, or an alternative fastening means such as an adhesive, can be used with equal success as will be understood by one of ordinary skill in the art.

A generally arcuate recess 26 is defined in the spacer 16 and extends inwardly from one edge thereof. In the embodiment under discussion, the arcuate recess has a generally circular configuration and an arc length defined by an angle of greater than 180° C. The bottom wall 28 of the recess defines a generally fixed surface for reasons that will become more apparent hereinbelow.

The arcuate recess is adapted to receive an actuating means such as rotor 30. The rotor is preferably concentrically positioned within the generally circular recess 26 and rotates about a central axis defined by pin mounting 32. The pin mounting extends inwardly from the first and second walls of the housing and rotatably receives the rotor thereon. The diameter of the rotor is substantially less than the open area defined by the arcuate recess 26 so that an annular channel 34 is defined therebetween. Due to the concentric relationship between the rotor and arcuate recess, the annular channel is of relatively constant dimension throughout its arc length.

A substrate 40 has a generally strip-like configuration and is received within the annular channel 34. The substrate is secured to the arcuate recess wall 28. A first end 42 extends outwardly from the housing 10 and is adapted for electrical connection with lead lines B and C while a second end 44 similarly extends from the housing.

With continued reference to FIGS. 1 and 2, and additional reference to FIGS. 3-5, alternate configurations of the substrate will be described in greater detail. For ease of illustration and discussion herein, like elements are identified by like numerals with a primed (′) or double primed (″) suffix and new elements are identified by new numerals. For purposes of this discussion, the substrate 40 includes a first member or conductive strip 46 and a second member or strip 48. Hereinafter, the combination of the substrate with the first and second strips 46, 48 will be referred to as impedance means. As indicated above, the impedance means is interposed between the rotor 30 and the recess wall 28. The impedance means cooperates with a wiper 50 to vary the total resistance between the first member 46, the second member 48, and the wiper 50.

Figure 3:
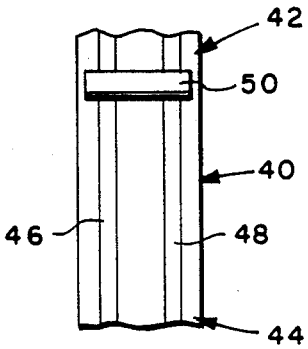
FIG. 3 is a plan view of the conductive/resistive elements of a polymer thick film cooperating with a conductive elastomeric wiper.

In accordance with the embodiment of FIG. 3, the first strip 46 is comprised of a conductive material and may be conveniently printed on the surface of the substrate 40. The second member 48 is likewise formed of a resistive material and is also typically printed on the surface of the substrate. The strips are illustrated in generally parallel configuration and electrically connected or bridged by wiper 50.

The wiper 50 of FIGS. 1-3 is formed of a conductive elastomer so that electrical contact is established between the first conductive member 46 and the second resistive member 48 through the wiper 50. For purposes of this discussion, an elastomer is defined as a synthetic polymer with rubber-like characteristics and includes a conductive rubber or silicon material. Present preferred practice utilizes a carbon filled silicon elastomer, specifically, Manufacturer's Compound Number 862, Part Number 86-10003, available from Tecknit EMI Shielding Products, a TWP company, located in Santa Barbara, Calif. Although this elastomer has been found satisfactory, it will be understood by those of ordinary skill in the art that alternative compounds exhibiting similar properties can be used. Additionally, the electrical conductivity properties of the elastomer may be varied through regulation of the carbon content.

Figure 6A:
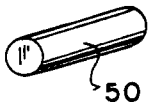
FIGS. 6A-C illustrate three alternate conformations of a wiper formed in accordance with the subject invention.
Figure 6B:
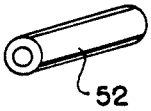

In the arrangement shown in FIGS. 1–3, and as briefly detailed above, the wiper 50 is of generally cylindrical configuration and preferably adapted for rolling contact with the impedance means. For example, the wiper configurations illustrated in FIGURES 6A and 6B are of generally cylindrical conformation and compressingly received between the rotor 30 and impedance means. Higher contact forces between the conductive elastomer wiper 50 and the impedance means can be achieved than in prior construction due to the wiper's conpressibility. This arrangement also reduces the contact resistance between the wiper and first and second members 46, 48, respectively. Further, the rolling contact significantly limits wear of the first and second members 46, 48, in addition to maintaining a generally constant, contact force. The resultant low noise and infinite point contact are further advantageous features resulting from use of the conductive elastomer.

Figure 4:
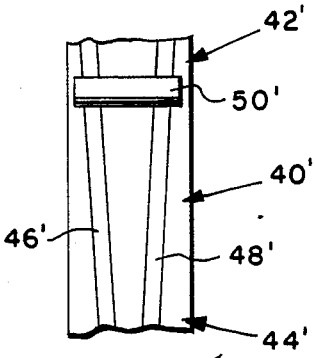
FIG. 4 is a plan view of an alternate tapering arrangement of the conductive/resistive elements cooperating with a conductive elastomeric wiper.

Turning now to FIG. 4, an alternate wiper and impedance means arrangement is illustrated. The wiper 50' is, once again, a conductive elastomer that rolls over non-parallel conductive strips 46', 48'. Since both the first and second strips are formed of a conductive material, the volume resistivity of the conductive rubber comes into consideration to vary the impedance in the electrical circuit. Thus, the non-parallel arrangement of the first and second conductive strips 46', 48' varies the longitudinal length of the conductive elastomer wiper 50' that extends therebetween. Rotation of the wiper varies the resistance through the first strip 46', the wiper 50', and the second strip 48'.

Figure 5:
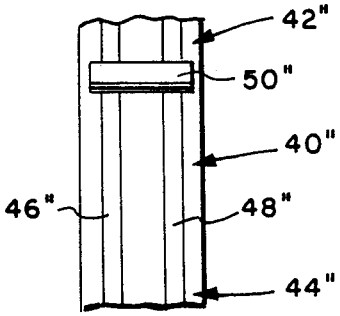
FIG. 5 is yet another alternate embodiment in which the conductive/resistive elements are formed of an elastomer and cooperate with a conductive wiper.

The alternate arrangement of FIG. 5 employs a first conductive strp 46'' in generally parallel relation with second conductive strip 48''. Both of these strips are formed of the conductive carbon filled silicon elastomer material described above with respect to the wiper 50 or 50'. The wiper 50'' is, therefore, formed from a suitable conductive metal or other conductive material. Preferably wiper 50'' has a generally cylindrical configuration so that it may define a rolling conductive member with strips 46'' and 48''. Once again, the volume resistivity of the conductive rubber, this time associated with the conductive strips 46'', 48'', rather than the wiper, varies the total resistance of the circuit as the wiper rolls from first end 42'' toward second end 44'', or vice versa, of the impedance means.

Figure 6C:
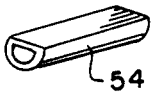

The conductive elastomer wiper 50 is shown in FIG. 6A and is of generally solid, cylindrical configuration. It has an axial length designed to effectively bridge the gap between the first and second strips 46, 48 of the impedance means. Yet another wiper configuration 52 is shown in FIG. 6B. It has a generally hollow, cylindrical configuration designed to reduce the total amount of conductive elastomer and/or tailor the compressibility of this member without any loss in performance. Still another alternate conformation 54 shown in FIG. 6C is preferred for sliding contact. It, too, is elongated and has a hollow, generally D-shaped cross-sectional configuration. Still other conformations of the wiper may be utilized in accordance with the subject invention although those configurations having a generally rounded, outer periphery are preferred.

Although a rolling contact between the wiper and first and second strips is advantageously used in the preferred and alternate embodiments of FIGS. 3-5, it will be readily understood by those skilled in the art that a sliding type arrangement may continue to be used. For example, the wiper may be fixed to the rotor and slidingly engage selected portions of the conductive/resistive strips to alter the resistance in an electrical circuit. Many, if not all, of the above-noted features are retained even if a sliding, rather than a rolling, arrangement is utilized.

Referring again to FIG. 1, operation of the variable impedance apparatus A will be described in greater detail. As is apparent, the wiper 50 is compressed in the annular channel 34 between the rotor and recess wall 28. The impedance means 40 is secured to recess wall 28 or trapped between wiper 50 and recess wall 28. Selective actuation of the rotor, in turn, rotates the wiper to various positions in the recess and to various "bridging" relations with the first and second strips 46, 48.

Figure 7:
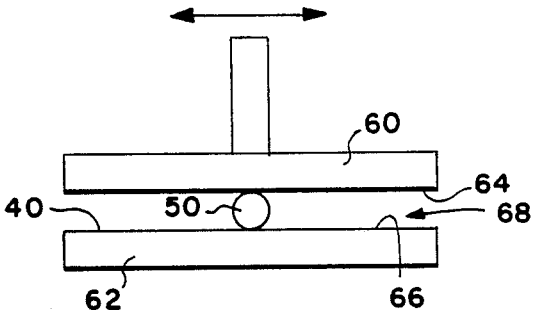
FIG. 7 is another alternate embodiment illustrating a conductive wiper interposed between generally parallel surfaces.

The alternate construction of FIG. 7 further demonstrates the versatility of the subject invention. The wiper 50 is interposed for rolling movement between first and second members 60, 62. The first member 60 has a generally planar surface 64 disposed in substantially parallel relation with a generally planar surface 66 of the second member. The parallel relation between the planar surfaces 64, 66 defines a generally constant dimension gap or channel 68, comparable to the annular channel 34 in the FIG. 1 embodiment, during movement of member 60. The wiper is slightly compressed in the channel 68 and maintains a constant contact force with impedance means 40 secured to the planar surface 66.

Although the first member is illustrated as moving relative to the second member, one skilled in the art will recognize that the second member 62 could move while the first member remains stationary. Likewise, both the first and second members can move in opposite directions to vary the position of the impedance means with respect to the wiper. It will also be recognized that the roller could be secured to either one of the first and second members when the impedance means is secured to the other of these members.

Figure 8:
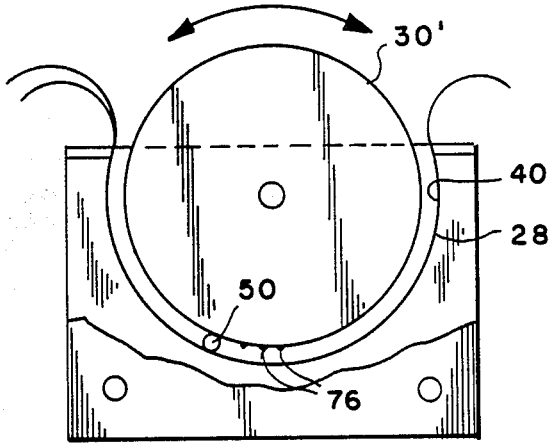
FIG. 8 illustrates inclusion of stub teeth or porjections into a device similar to that shown in FIG. 1.
Figure 9:
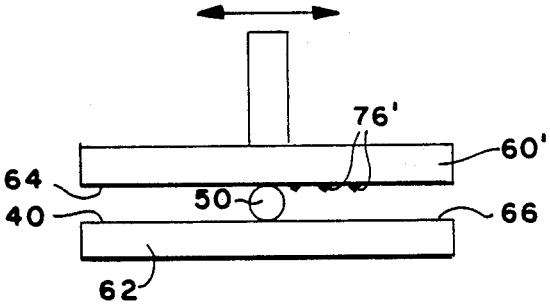
FIG. 9 shows the inclusion of stub teeth or projections into the embodiment shown in FIG. 7.

The rotor 30' is modified in the FIG. 8 embodiment to include a series of outwardly extending projections or stub teeth 76. The stub teeth are disposed on the periphery of the rotor to achieve a particular "feel" or to selectively find various points in the full range of rotor mevement. Likewise, the parallel, sliding arrangement of FIG. 7 is modified in FIG. 9 to incorporate stub teeth 76'. Once again, the stub teeth facilitate ease of positioning the wiper at preselected points along the impedance means. These preselected points coincide with certain impedance values or switching points. In a similar manner, the periphery of the elastomeric wiper can be provided with one or a series of longitudinally extending ridges or projections parallel to the central axis of the generally cylindrical wiper. The ridges (not shown) would thereby provide a similar "feel" to find various points in the full range of rotor movement comparable to the stub teeth utilized in the FIGS. 8 and 9 embodiments.

Figure 10:
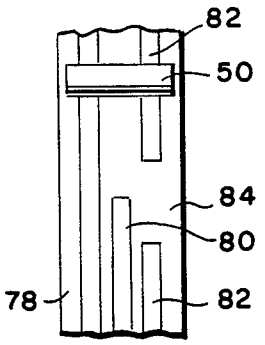
FIGS. 10 and 11 show two further arrangements of conductive/resistive elements adapting the subject invention to switching, timing, and like applications.
Figure 11:
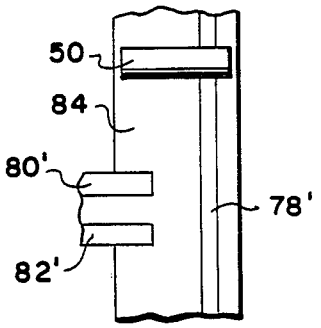

Adaptability of the elastomeric wiper 50 to switching operations is shown in FIGS. 10 and 11. For example, a first conductive strip 78 is printed on substrate 84 and connected to a source of electrical energy while second and third conductive strips 80, 82 are connected to associated equipment, circuits, or the like. The conductive strips 80, 82 are segmented so that depending on the position of the elastomeric wiper 50, either one strip or the other, or both, is selectively connected to conductive strip 78. Thus, as shown in FIG. 10, conductive strip 82 is connected to electrical power through the elastomeric wiper 50 and conductive strip 78 while the conductive strip 80 remains isolated. Repositioning of the elastomeric wiper will, of course, selectively alter the electrical interconnections. Similarly, if the rotor 30 is driven by a synchronous motor (not shown) the arrangement can be used as a timing device for switching circuits.

The arrangement of FIG. 11 illustrates that the conductive strips need not be defined by a generally parallel strip design on the substrate. In this embodiment, the conductive element or strip 78 is, again, disposed in elongated, generally parallel relation with the substrate. On the other hand, conductive elements 80' and 82' are disposed in generally perpendicular relation with the first conductive strip. Movement of the elastomeric wiper along the first conductive strip provides only limited regions of contact with the second and third conductive strips due to their generally perpendicular orientation with the first strip. FIGS. 10 and 11 are representative of but two of many different patterns of conductive elements that can be printed on the substrate. Also, one, some, or none of the elements may be resistive.

Figure 12:
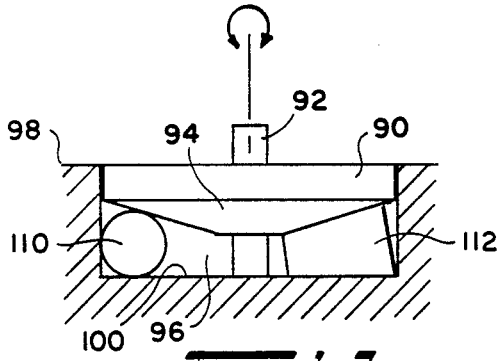
FIG. 12 is a side elevational view of an alternate embodiment incorporating a beveled rotor.
Figure 13:
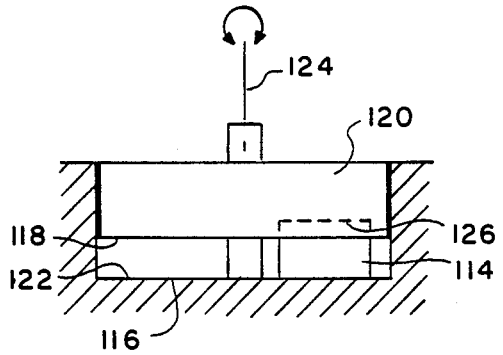
FIG. 13 is a side-elevational view of yet another embodiment in which the wiper is fixed to the rotor.

Turning now to FIGS. 12 and 13, still further embodiments of the subject invention will be described in greater detail. A rotor 90 is selectively rotated about a central axis defined by pin mounting 92. The rotor includes a generally frusto-conical surface 94 that faces inwardly toward cavity 96 defined in base member 98. An impedance means 100 is secured to a lower surface of the cavity in facing relation with frusto-conical surface 94. Interposed between these surfaces is, alternately, a spherical elastomeric wiper 110 or a cylindrical elastomeric wiper 112 so compressed as to abuttingly engage the frusto-conical surface 94 and the impedance means 100. In all other respects, this embodiment operates like the arrangement shown in FIG. 1.

The wiper 114 in FIG. 13 is also a conductive elastomeric material but is adapted for sliding engagement with the associated impedance means 116. The inner surface 118 of rotor or disc 120 is generally planar and disposed in parallel relation with a supporting surface 122. Thus, rotation of the disc about its central axis 124 varies the position of the wiper with respect to the impedance means. In the embodiments described above, the elastomeric wiper has been illustrated in rolling engagement with the rotor and impedance means. In the embodiment under discussion, a recess or cavity 126 is defined in the rotor for securely mounting the wiper therein. Therefore, although the wiper is still under slight compression to maintain electrical contact with the conductive or resistive strips, the wiper slides across the impedance means as it rotates with the disc. Still other sliding arrangements are contemplated by the subject invention. For example, opposed ends of the elastomeric wiper can engage generally parallel surfaces and complete electrical contact therebetween.

Figure 14:
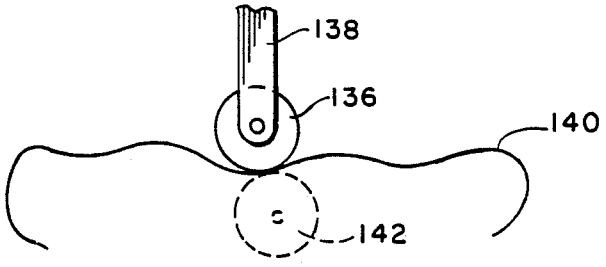
FIG. 14 illustrates a rotating wiper cooperating with a moving impedance means.

Lastly, and with reference to FIG. 14, a conductive elastomeric wiper 136 is rotatably mounted on support 138. A moving impedance means 140 is disposed in abutting relation with the wiper so that contact is established with the conductive or resistive strips on the substrate. A support roller 142 is one manner of maintaining sufficient contact between the wiper and impedance means. Conventional feed and take-up reels (not shown) can be utilized to move the impedance means relative to the wiper. Still other arrangements may be used for moving and supporting the impedance means without departing from the scope and intent of the subject invention.

Use of a conductive elastomer material eliminates the need for spring biasing used in conventional wiper arrangements. Further, the rolling engagement and generally cylindrical configuration of the wiper minimize the degradation and wear between the elements of the variable impedance apparatus.

The invention has been described with reference to the preferred embodiment. Obviously modifications and alterations will occur to others upon a reading and understanding of this specification. It is intended to include all such modifications and alterations insofar as they come within the scope of the appended claims or the equivalents thereof.

Having thus described the invention, it is now claimed:

1. An apparatus for varying impedance comprising:
- a first member adapted to receive an electrical current therethrough;
- a second member disposed in proximity to said first member and operatively associated therewith;
- a third member disposed in generally constant-force movable contact with said first and second members, one of said first, second and third members formed of resistive material whereupon movement of said third member with respect to said first and second members the overall pedance of said apparatus is varied.

2. The apparatus as defined in claim 1 wherein said first member is a conductive elastomer.

3. The apparatus as defined in claim 2 wherein said second member is a conductive elastomer.

4. The apparatus as defined in claim 2 wherein said third member is formed of a conductive material.

5. The apparatus as defined in claim 1 wherein said first and second members are conductive elastomers and said third member is formed of a conductive material.

6. The apparatus as defined in claim 1 wherein said third member is formed of a conductive elastomer.

7. The apparatus as defined in claim 6 wherein said second member is formed of a conductive material.

8. The apparatus as defined in claim 6 wherein said second member is formed of a resistive material.

9. The apparatus as defined in claim 1 wherein said third member is formed of a conductive elastomer and said first and second members are disposed in generally non-parallel relation.

10. An apparatus for varying impedance comprising:
- a first member adapted to receive an electrical current therethrough;
- a second member disposed in proximity to an operatively associated with said first member; and,
- a conductive member in generally constant-force rolling contact with said first and second members for completing electrical contact therebetween one of said members being formed of resistive material, wherein the overall impedance of said device is varied by said rolling contact.

11. The apparatus as defined in claim 10 wherein said conductive rolling member has a generally circular peripheral portion.

12. The apparatus as defined in claim 10 wherein said conductive rolling member has a generally hollow cross-sectional configuration.

13. The apparatus as defined in claim 10 wherein said conductive rolling member is an elastomer.

14. An apparatus for varying impedance comprising:
- a housing having a first surface;
- an actuator member received in said housing and adapted for operative movement relative to said first surface;

impedance means interposed between said actuator member and said first surface; and, a conductive member interposed between said actuator member and said first surface, said conductive member disposed between said actuator member and said first surface and operative for substantially constant-force moving contact with said impedance means, wherein the overall impedance of said apparatus is varied by said moving contact.

15. The apparatus as defined in claim 14 wherein said impedance means includes a conductive member and a resistive member adapted for electrical contact with said conductive rolling member.

16. The apparatus as defined in claim 14 wherein said impedance means includes first and second conductive members adapted for electrical contact with said conductive rolling member.

17. The apparatus as defined in claim 16 wherein said first and second conductive members are elastomers.

18. The apparatus as defined in claim 16 wherein said conductive rolling member is an elastomer.

19. The apparatus as defined in claim 16 wherein said first and second conductive members are disposed in generally non-parallel relation to one another.

20. The apparatus as defined in claim 14 wherein said conductive rolling member is an elastomer.

21. An apparatus for varying impedance comprising: means defining a first surface;

an actuator operatively movable relative to said first surface;

impedance means integral between said actuator member and said first surface;

a conductive elastomeric member disposed in substantially constant-force moving engagement with said impedance means, said elastomeric member completing electrical connection with said impedance means, wherein the overall impedance of said apparatus is varied by said moving engagment.

22. The apparatus as defined in claim 21 wherein said elastomeric member is configured for rolling engagement with said impedance means.

23. The apparatus as defined in claim 21 wherein said elastomeric member is configured for sliding engagement with said impedance means.

24. The apparatus as defined in claim 21 wherein said elastomeric member is a conductive member.

25. The apparatus as defined in claim 21 wherein said actuator member includes detent means.

26. The apparatus as defined in claim 21 wherein one of said actuator member and conductive elastomeric member includes projections extending therefrom.

27. The apparatus as defined in claim 21 wherein said conductive elastomeric member is maintained generally stationary and said impedance means is moved relative thereto.

* * * * *